United States Patent [19]

Sano et al.

[11] 4,123,897

[45] Nov. 7, 1978

[54] SECOND JUMPER SPRING

[75] Inventors: Motohiro Sano; Ryoichi Ohki, both of Tokyo, Japan

[73] Assignee: Kabushiki Kaisha Daini Seikosha, Japan

[21] Appl. No.: 691,843

[22] Filed: Jun. 1, 1976

[30] Foreign Application Priority Data

Jun. 4, 1975 [JP] Japan ..... 50-67173

[51] Int. Cl.[2] ..... G04B 17/32

[52] U.S. Cl. ..... 58/59

[58] Field of Search ..... 58/116 R, 121 R, 121 A, 58/59; 267/36 R, 37 R, 37 A

[56] References Cited

U.S. PATENT DOCUMENTS

| | | | |
|---|---|---|---|
| 3,511,340 | 5/1970 | Simon-Vermot | 58/121 A X |
| 3,738,101 | 6/1973 | Simon-Vermot | 58/116 R |
| 3,789,604 | 2/1974 | Hurt | 58/59 |
| 3,991,556 | 11/1976 | Renaud | 58/59 |

*Primary Examiner*—Stanley J. Witkowski

*Attorney, Agent, or Firm*—Robert E. Burns; Emmanuel J. Lobato; Bruce L. Adams

[57] ABSTRACT

A jumper spring for use in a timepiece to releasably hold a toothed wheel comprises a spring member having a generally V-shaped portion engageable with the toothed wheel for releasably holding the wheel during use of the jumper spring, and an elongated arm portion connected to the V-shaped portion. A sputtered layer of chromium covers a part of the V-shaped portion and a sputtered layer of another material overlies the chromium layer. The other material is selected from the group consisting of either a hard material, such as $Al_2O_3$, TiC and SiC or a material having a low coefficient of friction, such as $MoS_2$ so as to provide the necessary hardness or low coefficient of friction needed to enable the jumper spring to withstand repeated engagement with the toothed wheel.

17 Claims, 3 Drawing Figures

SECOND JUMPER SPRING

BACKGROUND

This invention relates to a jumper spring, and more particularly to an improved second jumper spring engageable with: a second wheel in a timepiece.

A conventional second jumper spring is shown in FIG. 1 and comprises a spring member "*b*" and a pallet stone "*a*" adhered to the spring member "*b*" by means of an adhesive "*c*". A separate assembly operation is therefore required to attach the pallet stone "*a*" to the spring member "*b*". However, after long use of the pallet stone, the adhering operation must be repeated and such takes much time. Therefore, the overall production cost is high. Further, if the condition of the adhesion is unstable, the quality of the second jumper spring becomes severly lowered.

SUMMARY OF THE INVENTION

It is therefore an object of the present invention to eliminate the above-mentioned drawbacks and to provide an improved second jumper spring of good quality and made of a single piece which is partially covered only by a sputtering film including a hard material and/or a substance having a low coefficient of friction.

Another object of the present invention is to provide an improved second jumper spring capable of being produced at a low cost.

DETAILED DESCRIPTION OF THE INVENTION

Figure 1:
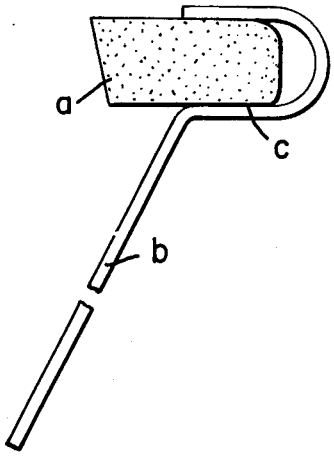
FIG. 1 PRIOR ART
FIG. 1 is a side view of a conventional second jumper spring.
Figure 2:
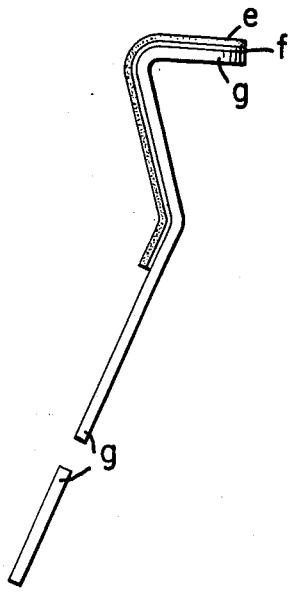
FIG. 2 is a side view of a second jumper spring of the present invention.
Figure 3:
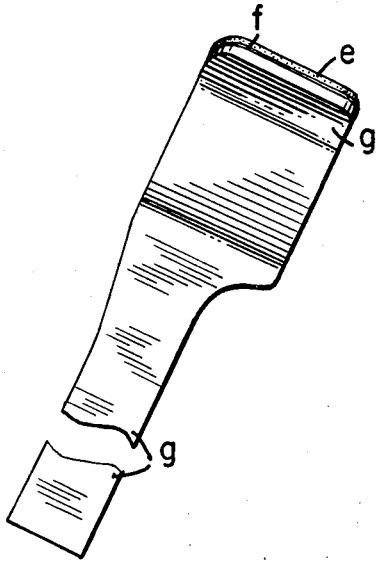
FIG. 3 is a front view of the second jumper spring of the present invention.

The present invention will be fully described by way of one embodiment thereof shown in FIGS. 2 and 3 which show a second jumper spring according to the present invention. A phosphor bronze is used as the material for a spring member "*g*" in view of its good working efficiency. The spring member *g* is initially subjected to a nickel plating operation so that the subsequent vacuum treatment thereof will be consistent and stabilized.

The spring member "*g*" has the shape shown in FIGS. 2 and 3 and comprises a generally V-shaped projecting portion connected to an elongated arm portion. The V-shaped portion of the jumper spring is configured to engage with the desired toothed wheel of the timepiece as is well known in the art and as shown, for example, in U.S. Pat. No. 3,991,556 to Jean Renaud. During formation, the projecting portion of the spring member is placed opposite a sputtering target and then, under vacuum, a sputtered layer or film "*f*" of chromium and *s* sputtered layer or film "*e*" of ultra-hard material are formed on the projecting portion of the spring member by sputtering. It is possible to obtain the same effect by selecting a material from the group consisting of a hard material such as an $A1_2O_3$, TiC, SiC or a material having a low coefficient of friction such as $MoS_2$ instead of the above-mentioned ultra-hard film. It is to be noted that a two-pole RF sputtering device is used for achieving the sputtered films "*e*" and "*f*".

Further, it is appreciated that the thickness of the chrome film "*f*" and ultra-hard film "*e*" preferable ranges from 0.5 – 3$\mu$.

A more detailed explanation of the sputtering operation is illustrated in the following examples.

EXAMPLE 1

(Condition of Sputtering)

| | |
|---|---|
| 1. size of target: | diameter: $150^{\phi}$mm × $5^{5}$mm |
| 2. material of target: | chrome<br>ultra-hard material (HI) |
| 3. spacing of electrodes: | 33 mm |
| 4. anode voltage: | 26 KV |
| 5. anode current: | 270 MA |
| 6. Ar sealing pressure: | $6 \times 10^{-2}$Torr |
| 7. sample material: | phosphor bronze |
| 8. time of treatment: | chrome— 10 minutes 0.3 $\mu$<br>ultra-hard material—<br>45 minutes 1.2 $\mu$ |

Since the second jumper spring according to the present invention is made of a single piece of spring material with a projection covered at its surface by a hardening film (chrome film "*f*", ultra-hard film "*e*"), the separate assembly or adhering operation required in the prior art is eliminated. As a result, a cost of the second jumper spring of the present invention is greatly lowered as compared to production costs for the prior art type jumper spring.

In addition, in endurance tests carried out over a period of six years, it was proven that the second jumper spring of the present invention is superior to conventional ones which have no sputtering film, as shown in the following Table 1.

TABLE 1.

Result Substrate Endurance Test during Six Years

| Sample Material | Wear Proof | Generation of White Powder | Result |
|---|---|---|---|
| jumper spring of the present invention | good | no | good |
| conventional ones (having pallet stone) | some good | yes | some good |
| jumper spring subjected to hard treatment 17-7PH (having no sputtering film) | rise of a driving torque of hands | yes (much) | bad |
| jumper spring having the same form of the present invention | bad | yes | bad |

As mentioned above, the second jumper spring according to the present invention brings about the following advantages:

(1) It is possible to reduce the manufacturing cost and the assembly time since no pallet stone is used and since the spring member is composed of phosphor bronze which is substituted for manganese nickel-silver (MnNs) used in the prior art.

(2) The endurance of the second jumper spring of the present invention is very good, and it is possible to avoid the formation of a white powder which forms from the jumper spring itself when the jumper spring is used for a long time. (The white powder forms as a result of a wear and tear between the contact surfaces of the second jumper spring and another contact member and is undesirable from a functional point of view.)

We claim:

1. A jumper spring for use in a timepiece to releasably hold a toothed wheel of the timepiece comprising: a spring member having an elongated arm portion, and a generally V-shaped projecting portion connected to said arm portion; a sputtered layer of chromium covering part of said projecting portion; and a sputtered layer of material overlying said layer of chromium, said material being selected from the group consisting of a hard material or a material having a low coefficient of friction.

2. A jumper spring according to claim 1; wherein the said hard material is selected from the group consisting of $A1_2O_3$, TiC and SiC.

3. A jumper spring according to claim 1; wherein the said hard material comprises $A1_2O_3$.

4. A jumper spring according to claim 1; wherein the said hard material comprises TiC.

5. A jumper spring according to claim 1; wherein the said hard material comprises SiC.

6. A jumper spring according to claim 1; wherein the said material having a low coefficient of friction comprises $MoS_2$.

7. A jumper spring according to claim 1; wherein said spring member is composed of phosphor bronze.

8. A jumper spring according to claim 1; wherein the combined thickness of the two sputtered layers ranges between 0.5$\mu$ to 3$\mu$.

9. A jumper spring for use in a timepiece to releasably hold a toothed wheel of the timepiece comprising: a spring member having an elongated arm portion, and a projecting portion connected to said arm portion and being configured to engage with a toothed wheel of a timepiece during use of the pumper spring; a sputtered layer of chromium covering part of said projecting portion; and a sputtered layer of material overlying said layer of chromium, said material being selected from the group consisting of a hard material or a material having a low coefficient of friction.

10. A jumper spring according to claim 9; wherein the said hard material is selected from the group consisting of $Al_2O_3$, TiC and SiC.

11. A jumper spring according to claim 9; wherein the said hard material comprises $Al_2O_3$.

12. A jumper spring according to claim 9; wherein the said hard material comprises TiC.

13. A jumper spring according to claim 9; wherein the said hard material comprises SiC.

14. A jumper spring according to claim 9; wherein the said material having a low coefficient of friction comprises $MoS_2$.

15. A jumper spring according to claim 9; wherein said spring member is composed of phosphor bronze.

16. A jumper spring according to claim 9; wherein the combined thickness of the two sputtered layers ranges between 0.5$\mu$ to 3$\mu$.

17. A jumper spring according to claim 9; wherein said projecting portion has a generally V-shape with one leg of the V being connected to said elongated arm portion and the apex of the V being configured to engage with the toothed wheel.

* * * * *